US005584600A

United States Patent [19]

Langdon

[11] Patent Number: 5,584,600

[45] Date of Patent: Dec. 17, 1996

[54] SOIL EROSION CONTROL AND VEGETATION RETARDANT

[76] Inventor: Christopher D. Langdon, P. O. Box 904, Tryon, N.C. 28782

[21] Appl. No.: 341,090

[22] Filed: Nov. 17, 1994

[51] Int. Cl.[6] ..... E02D 17/20

[52] U.S. Cl. ..... 405/16; 405/15; 405/258

[58] Field of Search ..... 405/15, 16, 17, 405/19, 258; 47/1 F

[56] References Cited

U.S. PATENT DOCUMENTS

| | | | |
|---|---|---|---|
| 1,206,891 | 12/1916 | Nelson . | |
| 2,092,183 | 9/1937 | Rehfeld | 61/38 |
| 2,143,461 | 1/1939 | Waring | 405/19 X |
| 4,610,568 | 9/1986 | Koerner | 405/19 |
| 4,798,498 | 1/1989 | Hallberg | 405/285 |
| 4,804,293 | 2/1989 | Varkonyi et al. | 405/15 |
| 5,040,572 | 8/1991 | Lindberg | 139/410 |
| 5,160,215 | 11/1992 | Jensen | 405/16 X |
| 5,249,893 | 10/1993 | Romanek et al. | 405/15 X |

FOREIGN PATENT DOCUMENTS

| | | | |
|---|---|---|---|
| 293392 | 8/1991 | Germany | 405/258 |
| 21630 | 2/1982 | Japan | 405/258 |
| 173182 | 9/1985 | Japan | 405/16 |
| 296015 | 12/1987 | Japan | 405/258 |
| 4319117 | 11/1992 | Japan | 405/16 |
| 6207413 | 7/1994 | Japan | 405/19 |
| 655761 | 4/1979 | U.S.S.R. | 405/16 |
| 1691455 | 11/1991 | U.S.S.R. | 405/15 |
| 1715983 | 2/1992 | U.S.S.R. | 405/258 |
| 1772299 | 10/1992 | U.S.S.R. | 405/15 |

*Primary Examiner*—Tamara L. Graysay
*Assistant Examiner*—Frederick L. Lagman
*Attorney, Agent, or Firm*—Christopher C. Dremann; Ralph H. Dougherty

[57] ABSTRACT

A ground cover for controlling soil erosion and retarding vegetation growth on sloped ground includes a plurality of spaced apart water control baffles and a series of thin, sheet-like membranes between pairs of the water control baffles. The ground cover is secured to the ground by a plurality of ground engaging fasteners. The water control baffles preferably include a vertical leg having a plurality of apertures therethrough, and a ground engaging leg, which is substantially horizontal to the ground, for receiving the ground engaging fasteners. The membranes allow water to flow through the membrane while preventing erosion of the soil underneath the membrane.

11 Claims, 3 Drawing Sheets

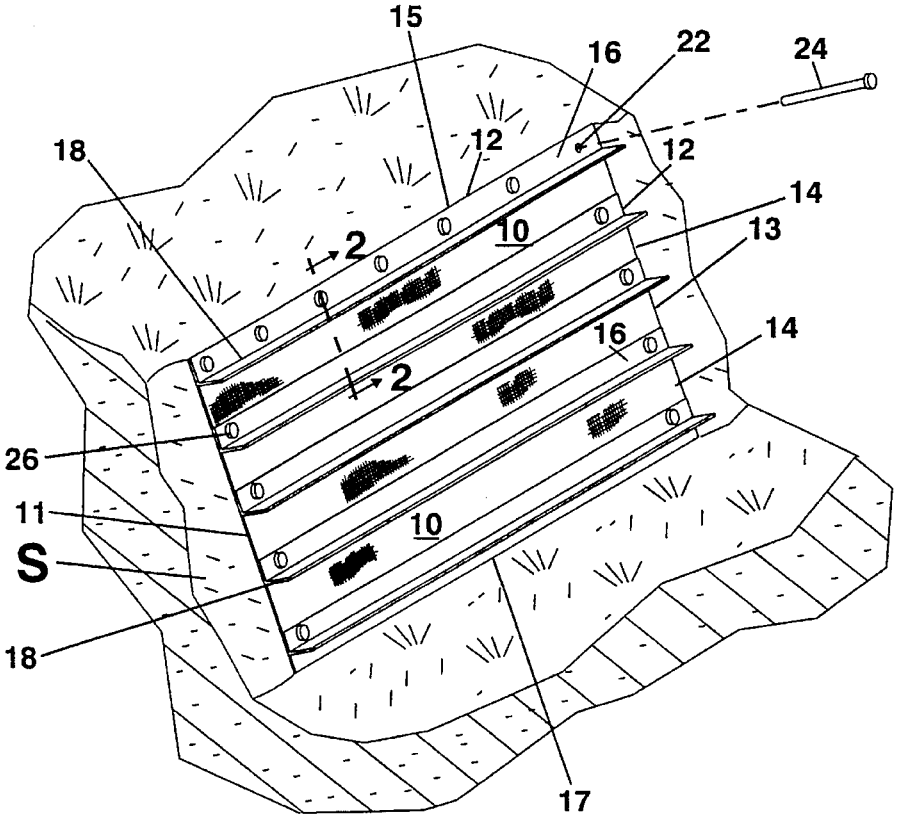
Fig.1
Fig.2
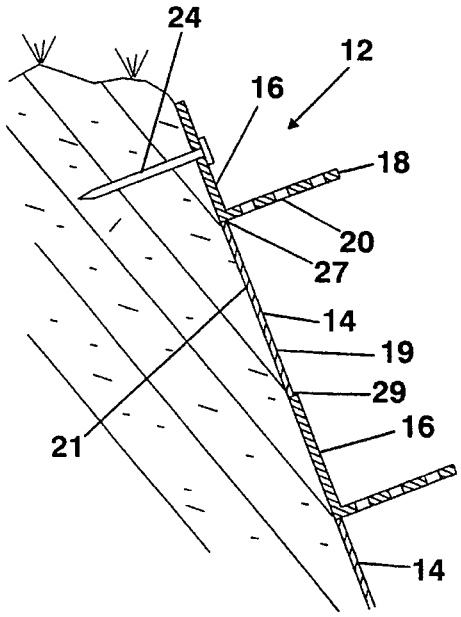
Fig.3
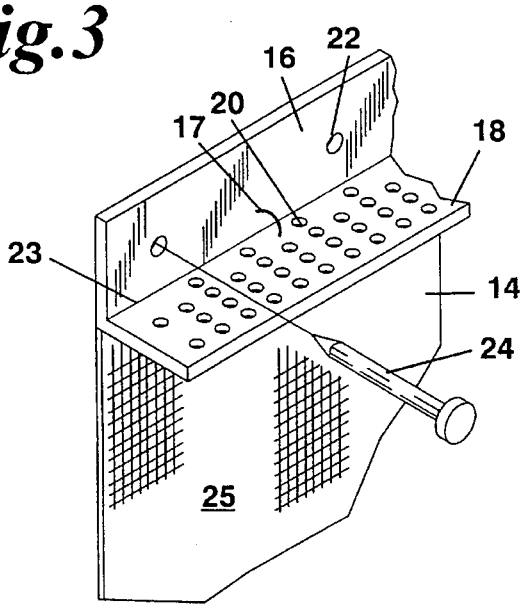

SOIL EROSION CONTROL AND VEGETATION RETARDANT

BACKGROUND OF THE INVENTION

1. Field of the Invention

This invention pertains to soil erosion prevention and aggregate and vegetation control in general and specifically for use on slopes where heavy rain causes erosion of soil and/or mudslides.

2. Background of the Prior Art

The prior art discloses soil erosion control devices such as mats, coverings for banks employing wire mesh, and cells filled with material for the protection of steep surface areas.

Representative of the prior art are U.S. Pat. Nos. 1,206,891; 2,092,183; 4,798,498; 4,804,293; and 5,040,572.

The difficulty with these devices is that they are very cumbersome and expensive to install.

SUMMARY OF THE INVENTION

There is a need for an efficient soil erosion control device which is simple in construction and easy to manufacture.

It is an object of this invention to provide a soil erosion control device which is inexpensive to produce and simple to install.

It is another object of this invention to provide an efficient soil erosion control device with water flow control so as to prevent soil erosion and the washing away of bulk material, i.e., mulch, gravel, etc.

It is still another object of this invention to provide for soil erosion control and vegetation retarder for bare soil areas.

And yet another object of this invention is to provide a ground cover for bare soil having water flow control laterally and vertically of the cover thereby preventing soil erosion.

The device of this invention prevents a rush of water flow on a steep bank or slope so that soil and aggregate material is not washed away.

The device of this invention is a ground cover which is spread over a steep bank or slope and has a series of water control baffles in spaced apart parallel arrangement with sheets of material such as water permeable membranes connected between the baffles whereby water flow on a steep bank or slope trickles downwardly through apertures in the baffles and permeates through the ground cover water permeable membranes into the soil without causing erosion.

The membranes may be plastic, fabric or a water permeable material which also function to prevent growth of undesirable vegetation yet allows for planting of desirable flowers, shrubs and the like through select openings in the cover.

These and other objects of the invention will become apparent to those skilled in the art to which the invention pertains from a reading of the following specification when taken with the annexed drawings.

BRIEF DESCRIPTION OF THE DRAWINGS

FIG. 1 is a perspective view of the invention laid on a steep bank or slope.

FIG. 2 is a side view of the device taken along the line 1—1 of FIG. 1 showing water control baffles with connecting sheets of material such as water pervious membranes or the like.

FIG. 3 is a perspective sectional view of the invention showing L-shaped baffles having water drainage apertures, anchoring means and water pervious membranes or material.

DETAILED DESCRIPTION OF THE PREFERRED EMBODIMENT OF THE INVENTION

Figure 4:
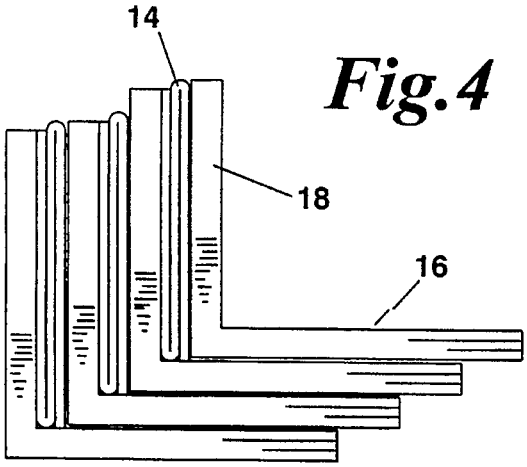
FIG. 4 shows the invention in stacked condition for transportation and/or storage.

Referring now to the drawings in more detail, FIG. 1 shows a blanket or covering 10 made of any suitable material having water permeable characteristics as well as vegetation retardation. The cover 10 is for use in controlling soil erosion and vegetation growth on steep banks or slopes S. The blanket 10 has longitudinal opposed edges 11 and 13, top and bottom edges 15 and 17 and top and bottom sides 19 and 21. The covering or blanket 10 is of sufficient size to cover a large area of ground or slope S. The blanket 10 comprises a series of parallel spaced apart water flow control baffles 12 attached to a fabric of water permeable membranes 14 or the like.

The water flow control baffles 12 of the blanket 10 is an L-shaped length of durable material having a ground engaging leg 16 and a water flow control vertical leg 18. The vertical leg 18 retards the flow of water flowing downwardly over the blanket 10 and prevents aggregate material on the ground cover from washing away. In this regard, legs 18 of the baffles 12 have a series of apertures 20 throughout its width and length for the slow passage of water. It can be seen that water flowing down the blanket or ground cover 10 is retarded by the vertical legs 18 yet water slowly flows through the apertures 20 thus avoiding a rush of water both vertically and laterally of the cover 10.

Water flowing through the apertures 20 is directed onto the fabric 14 which may be any durable plastic material or a water permeable membrane and seeps through it into the soil. The fabric/membrane 14 is typically water permeable to allow flow of water through the fabric/membrane but prevents upward movement of soil through bottom side 21. The ground engaging leg 16 is impervious to water both upwardly and downwardly. Optional, selectively arranged slits or openings 19 in the membranes 14 allow for access to the soil for planting flowers or other desirable shrubbery.

The L-shaped baffles 12 are arranged in spaced-apart parallel relationship longitudinally of the blanket 10 and are fastened to the membranes 14 by any suitable means. The upper most L-shaped baffle 12 has a series of apertures 22 in the ground engaging leg 16 for receiving ground engaging fasteners 24, FIG. 3. The remaining L-shaped baffles 12 have apertures 26 at their distal ends for receiving the ground engaging fasteners 24.

It will be understood that several of the covers or blankets 10 may be arranged together both vertically and horizontally to cover a large area. In this regard, the edges 11 and 13 of adjacent blankets 10 may overlap and be fastened together with common fastener 24.

As seen in FIGS. 2 and 3, the fastener 24 penetrates the soil a sufficient depth to ensure that the blanket 10 remains in place on the slope S. The legs 16 and 18 may be rigid as shown and stacked together as seen in FIG. 4. Alternatively, the leg 18 may have a hinge 17, FIG. 3, extending longitudinally of its edge 23 to allow the legs 18 to lay flat against leg 16. This construction facilitates compactness of the entire blanket and baffles for transportation or storage. The hinge 17 contemplated may be of the flexible variety integral along the junction or edge 23 with the legs 16 and 18.

In FIG. 2, it is seen that the membranes 14 are a series of strips of suitable fabric material 25 attached at their edges 27 and 29 to and between baffles 12 by any suitable means. Alternately, the membranes 14 may be a single length of material with the legs 16 fastened to it by any know method. The obvious advantage of the latter construction simplifies the attachment of the legs 16 to the fabric or membrane.

Figure 7:
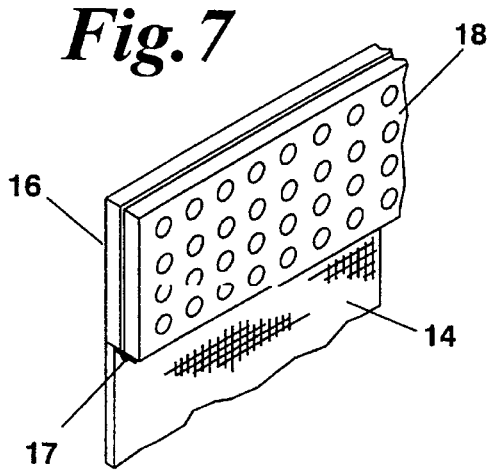
FIG. 7 shows the T-shaped baffle in collapsed arrangement for storage or transportation.

In FIG. 4, the L-shaped legs 16 and 18 are stacked against each other with the fabric or membrane 14 folded in between the adjacent legs 18. This provides for compactness in packaging and storing. FIG. 7 shows the leg 18 folded against leg 16 made possible by the hinge 17 which extends longitudinally along edge 23 of the legs 16 and 18. In this construction, the membrane 14 is folded against side 25 of leg 18, FIGS. 2 and 7.

Figure 6:
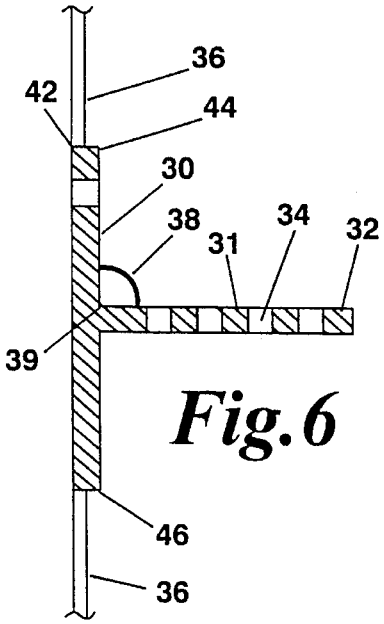
FIG. 6 is an end view of the T-shaped baffle.
Figure 5:
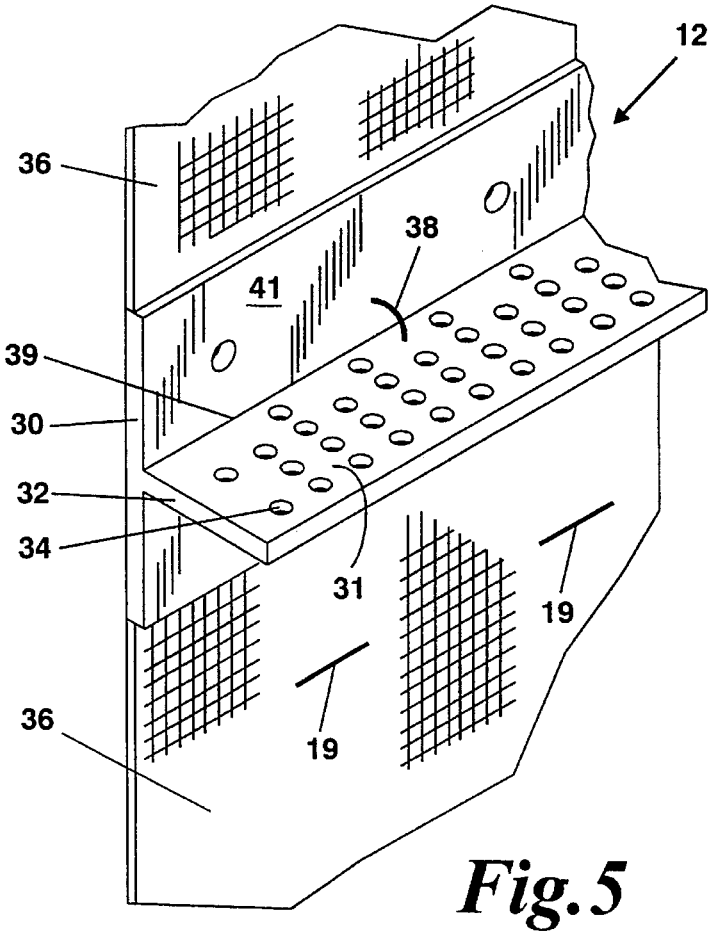
FIG. 5 is another embodiment of the baffle in T-shaped configuration.

Another embodiment of the invention is shown in FIGS. 5 and 6. The water control baffles 12 is a T-section with a soil engaging leg 30 and a vertical water control leg 32 having apertures 34 for the passage of water. Sections of fabric such as water permeable material or membranes 36 are attached to and between T-sections 12 as shown. A flexible hinge 38 extending longitudinally along edge 39 allows the face 31 of vertical leg 32 to collapse or be folded against the face 41 of horizontal leg 30. This construction permits the T-sections 12 and membrane 36 to be stacked together for transportation and storage as shown in FIG. 7.

Again, it is seen that the membranes 36 are connected by their edges 42 to the upper and lower edges 44 and 46 of the horizontal leg 30 of the T-section, FIG. 5.

Figure 8:
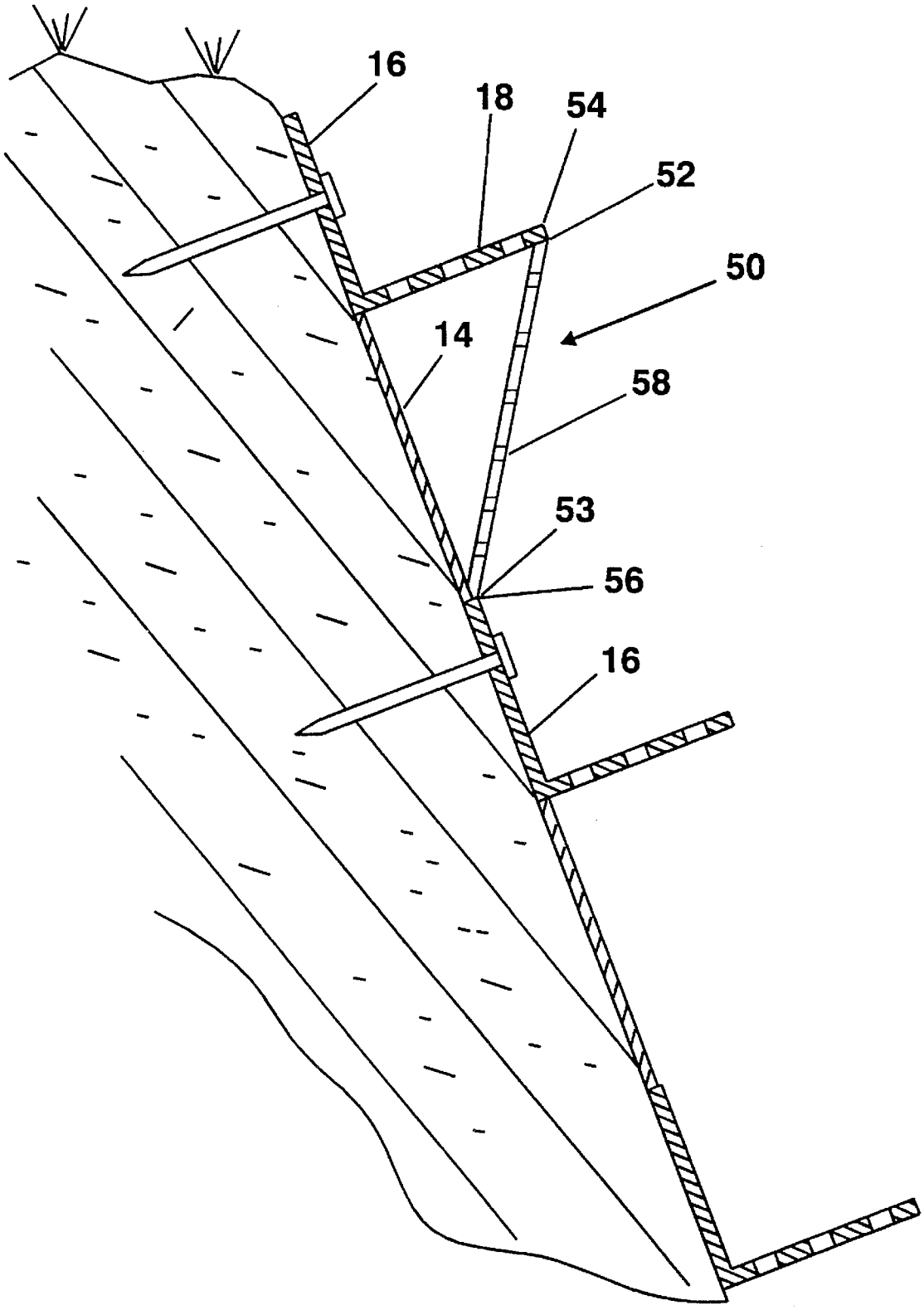
FIG. 8 is a side view of yet another embodiment of the L-shaped baffle with a diagonal brace.

The embodiment of FIG. 8 shows L-shaped legs 16 and 18, membrane 14 and a diagonal brace or sheet 50. The brace 50 is removably anchored at its top 52 to the upper edge 54 of the leg 18 and removably anchored at its lower end 53 to the edge 56 of leg 16. The diagonal brace 50 extends across the width of the cover 10 from edge 11 to edge 13. A plurality of holes 58 in the brace 50 permits water to flow through to the membrane 14. The brace 50 prevents the leg 18 from collapsing downwardly and for retaining aggregate between the legs 18. The anchoring means may be any form of U-shaped joints such that brace or sheet 50 may be slidable or snapped into place.

While the invention has been described with regard to a particular embodiment thereof, it will be apparent to those skilled in the art to which the invention pertains that numerous changes may be made to enhance its usefulness without departing from the spirit and scope thereof.

What I claim is:

1. A ground cover for controlling soil erosion and retarding vegetation growth on sloped ground comprising:

a thin, sheet-like membrane; and a water flow control baffle comprising a vertical leg having a plurality of planar apertures therethrough;

said membrane for placement on the sloped ground with said water flow control baffle placed thereon to control soil erosion and to retard vegetation growth on the sloped ground.

2. A ground cover according to claim 1 wherein said water flow control baffle further comprises a ground engaging leg substantially horizontal to the sloped ground, said ground engaging leg having a plurality of apertures therethrough for receiving a corresponding plurality of fastening means for securing the ground cover to the sloped ground.

3. A ground cover according to claim 2 wherein said vertical leg and said ground engaging leg of said water flow control baffle define an L-shaped cross section.

4. A ground cover according to claim 2 wherein said vertical leg and said ground engaging leg of said water flow control baffle define a T-shaped cross section.

5. A ground cover according to claim 1 wherein said membrane is water permeable to allow water to flow through the membrane into the sloped ground.

6. A ground cover according to claim 1 wherein said membrane has at least one opening therethrough.

7. A ground cover according to claim 1 wherein said water flow control baffle further comprises a brace fixed at one end to said vertical leg and extending outwardly therefrom.

8. A ground cover according to claim 7 wherein said brace has at least one aperture therethrough.

9. A ground cover according to claim 1 comprising:

a plurality of said water flow control baffles spaced apart; and a plurality of said membranes, each positioned between a pair of said plurality of water control baffles.

10. A ground cover according to claim 9 wherein said plurality of water flow control baffles are attached to said plurality of membranes, and wherein said plurality of baffles and said plurality of membranes are adapted to fold together for storage and transportation.

11. A ground cover according to claim 9 wherein at least two of said plurality of water flow control baffles are positioned substantially perpendicular to each other to prevent vertical and lateral movement of aggregate material placed on said membrane of the ground cover.

* * * * *